US006682379B1

(12) United States Patent
Walczak et al.

(10) Patent No.: US 6,682,379 B1
(45) Date of Patent: Jan. 27, 2004

(54) COWL LATCHING SYSTEM WHICH SIMPLIFIES THE COWL REMOVING PROCESS

(75) Inventors: Thomas J. Walczak, Oconomowoc, WI (US); Glenn E. Anderson, Omro, WI (US); Timothy D. Krupp, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 10/309,694

(22) Filed: Dec. 4, 2002

(51) Int. Cl.[7] ..... B63H 21/26

(52) U.S. Cl. ..... 440/77; 123/195 P; 292/106; 292/207

(58) Field of Search ..... 440/76, 77; 123/195 P; 292/106, 121, 128, 129, 123, 207, 208, 229, 247

(56) References Cited

U.S. PATENT DOCUMENTS

| | | | | | |
|---|---|---|---|---|---|
| 4,348,194 | A | | 9/1982 | Walsh | 440/77 |
| 4,600,396 | A | | 7/1986 | Crane et al. | 440/77 |
| 4,844,031 | A | | 7/1989 | Boda et al. | 123/195 |
| 4,875,883 | A | | 10/1989 | Slattery | 440/77 |
| 4,927,194 | A | | 5/1990 | Wagner | 292/128 |
| 4,971,587 | A | * | 11/1990 | Uchida et al. | 440/77 |
| 5,025,763 | A | * | 6/1991 | Watanabe | 123/195 P |
| 5,120,248 | A | | 6/1992 | Daleiden et al. | 440/77 |
| 5,263,884 | A | * | 11/1993 | Oishi | 440/77 |
| 5,338,236 | A | | 8/1994 | Dunham et al. | 440/77 |
| 5,803,777 | A | * | 9/1998 | Hiraoka | 440/77 |
| 6,080,025 | A | * | 6/2000 | Isogawa et al. | 440/77 |

* cited by examiner

*Primary Examiner*—S. Joseph Morano
*Assistant Examiner*—Lars A. Olson
(74) *Attorney, Agent, or Firm*—William D. Lanyi

(57) ABSTRACT

A cowl latching system provides a retainer that is attached to the outboard motor and a catch device which is attached to a cowl structure. The catch device is shaped to allow the retainer to move between first and second extension portions. The retainer is provided with first and second retention members that can each move from a retracted position to an extended position under the urging of a resilient member such as a spring. The first and second retention members can also be urged from their respective extended positions to their respective retracted positions by the movement of the first and second extension portions of the catch device when the cowl structure is installed unto the outboard motor. The arrangement of the catch device and retainer simplifies the installation and removal of the cowl structure from the outboard motor by allowing the operator of a marine vessel to more easily and simply move the cowl structure relative to the stationary components of the outboard motor during both the installation and removal procedures.

22 Claims, 5 Drawing Sheets

COWL LATCHING SYSTEM WHICH SIMPLIFIES THE COWL REMOVING PROCESS

BACKGROUND OF THE INVENTION

1. Field of the Invention

The present invention generally relates to a cowl latching system, or mechanism and, more particularly, to a cowl latching system that allows the operator of a marine vessel to install or remove the cowl, from a position within the marine vessel,.without having to precisely align the cowl with the outboard motor during the initial steps of the installation or removal procedure.

2. Description of the Prior Art

Many different cowl latching systems are known to those skilled in the art of outboard motor manufacture and design. The cowl of an outboard motor is intended to provide a protective cover over the engine and related components of an outboard motor. The cowl must be latched to the outboard motor to prevent inadvertent disconnection of the cowl from the outboard motor during operation of a marine vessel.

U.S. Pat. No. 4,875,883, which issued to Slattery on Oct. 24, 1989, discloses a latch assembly for releasably securing cowl sections of an outboard motor. A cowl assembly for an outboard motor, including an upper cowl section and a lower cowl section is provided with an improved latch assembly. The latch assembly incorporates a pivotable hook connected to one of the cowl sections, which is engageable with a hook engaging member provided on a catch mechanism connected to the other cowl section. Due to the presence of a compressible seal between the upper and lower cowl sections, relative vertical movement is possible therebetween, and thereby between the hook and the hook engaging member. The improved latch mechanism incorporates a retainer mechanism for preventing disengagement of the hook from the catch mechanism during such relative vertical movement of the cowl sections, for ensuring that the cowl sections remain secured together during compression of the compressible seal between the cowl sections.

U.S. Pat. No. 4,927,194, which issued to Wagner on May 22, 1990, describes an interlock latch assembly for releasably securing cowl sections of an outboard motor. An interlock mechanism is provided for a latch assembly which releasably secures upper and lower cowl sections of an outboard motor. The interlock mechanism is movable between a locking position and a release position, and is normally disposed in its locking position, such as by a coil spring. The interlock mechanism is mounted to the latch handle, which is pivotably mounted to one of the cowl sections. A hook is interconnected with the latch handle, and is engageable with a catch assembly provided on the other of the cowl sections. The interlock assembly normally engages a stationary engagement pin provided on one of the cowl sections, which prevents accidental pivoting movement of the latch handle. The interlock mechanism is manually moveably to its release position, so that the latch handle can be pivoted so as to disengage the hook from the catch mechanism.

U.S. Pat. No. 5,120,248, which issued to Daleiden et al on Jun. 9, 1992, discloses a cam-type latching mechanism for securing cowl sections together. A latch system for securing upper and lower cowl sections of an outboard motor is disclosed. The latch system comprises a catch assembly located at one end of the cowl assembly, and a latch mechanism located at the other end of the assembly. The catch assembly includes a catch lock mounted to one of the cowl sections, with a catch slot formed in the catch block. A roller member is mounted to the other of the cowl sections, for engaging the catch slot. The catch slot is formed so as to provide an end wall against which the roller is maintained when the cowl sections are secured together, with the material of the catch block engaging the roller member to prevent relative vertical movement between the cowl sections. A cam block is located at the same end at the same end of cowl assembly as the latch mechanism and is mounted to one of the cowl sections. A cam follower is mounted to the other of the cowl sections and engages a cam surface formed on the cam block for facilitating movement of the roller member into the catch slot. A stationary latch member is engageable by a movable latch member in response to movement of the latch handle, to maintain the cam follower within the cam slot, and thereby to maintain the catch rollers within the catch slots. Relative vertical and horizontal movement between the cowl sections is thus prevented.

U.S. Pat. No. 5,338,236, which issued to Dunham et al on Aug. 16, 1994, describes a latch mechanism for an outboard motor cowl assembly. The outboard motor comprises a propulsion unit which includes a propeller shaft and a powerhead drivingly connected to the propeller shaft, and a cowling surrounding the powerhead, the cowling comprises a first cover member including an outer surface having therein a recess, a second cover member mating with the first member, and a selectively engageable latch mechanism for securing the second member to the first member. The latch mechanism includes a latch handle which is supported by the first member, which is movable in a first direction between a flush position wherein the latch handle is in the recess and is flush with the remainder of the outer surface of the non-flush position wherein the latch handle extends from the recess, and which is movable in a second direction to engage and disengage the latch mechanism.

U.S. Pat. No. 4,844,031, which issued to Boda et al on Jul. 4, 1989, discloses a rotary latch mechanism for securing cowl sections of an outboard motor. The outboard motor has a cowl assembly having an upper cowl section and a lower cowl section and includes various features for improving the structural integrity of the cowl assembly and for providing a water-resistant seal at the joint between the cowl sections and at various points of entry of cables and other mechanical devices. A rotary latch mechanism includes an internal hook connected to a shaft leading to an external rotatable handle. The shaft is supported on either side of the point of engagement of the hook to the shaft. In particular, a bearing is formed integrally with the bottom of the lower cowl section and is adapted to receive an end of the shaft for support thereof. The catch for the latch mechanism is provided with a hook-receiving member having support on both sides of the point of engagement of the hook-receiving member by the hook. A pair of depending arms is connected to an upper plate, which is adapted for direct connection to a pair of columnar lugs formed integrally with an end of the upper cowl section.

U.S. Pat. No. 4,600,396, which issued to Crane et al on Jul. 15, 1986, discloses a cowl latch for an outboard motor. A latch for the cowl of an outboard motor engine includes a catch mounted on one of the cowl members. A lever is pivotally attached to the other cowl member and a resilient spring member is pivotally attached to the lever. The lever and spring member act to provide an overcenter action on the lever when the latch is closed. The lever includes a shield to conceal the latch assembly.

U.S. Pat. No. 4,348,194, which issued to Walsh on Sep. 7, 1982, discloses a cowl for an outboard motor. A cowl for the powerhead of an outboard motor includes two bottom cowl members attached together by screws which also mount a latch bracket and a hinge member. The latch bracket supports a latch mechanism which, with the hinge member, serves to hold a top cowl member in place.

U.S. patent application Ser. No. 10/172,336 (M09576), which was filed by Walczak et al on Jun. 14, 2002, discloses an integral cowl latching mechanism for an outboard motor. The latching mechanism for the cowl of an outboard motor comprises a base portion that is formed as an integral part of the cowl structure itself. This integral base portion, which is shaped as one or more bosses, eliminates the need for additional brackets and fasteners to attach the latching mechanism to the cowl structure. The boss portion, which is an integral part of the cowl, is shaped to receive a pivot member and a latch to complete the structure of the latching mechanism. A latch pin, which is attached to another component, is shaped to be received through a hole in the boss portion to allow the latch to captivate the latch pin when the latch is in a latching position. This attaches the two cowl members, or cover members, to each other. The integral cowl latching mechanism is particularly suited for use in combination with the cowl latching system which will be described below.

The patents described above are hereby expressly incorporated by reference in the description of the present invention.

SUMMARY OF THE INVENTION

A cowl latching system for an outboard motor, made in accordance with the preferred embodiment of the present invention, comprises a cowl structure which is removably attachable to the outboard motor. It also comprises a retainer attached to the outboard motor. A first retention member is attached to the retainer, and is movable relative to the retainer between an extended position and a retracted position. A similarly configured second retention member is also provided. The first and second retention members are urged into their respective extended positions when no external force is present to urge the first and second retention members into their respective retracted positions. A catch device is attached to the cowl structure and it comprises a first extension portion and a second extension portion. The first and second extension portions can be disposed in a generally parallel association with each other. The first extension portion has a first extension surface and the second extension portion has a second extension surface. The first and second extension portions are spaced apart by a preselected distance which is selected to allow a portion of the retainer to pass between them. The preselected distance is also selected to urge the first and second retention members into their respective retracted positions when the catch device is moved along a first path in a first direction relative to the retainer. The catch device is removable from the retainer while the first and second retention members remain in their respective extended positions when the catch device is moved along a second path in a second direction relative to the retainer. The first and second directions are nonparallel to each other. The first and second retention members are shaped to prevent the first and second extension portions from moving past them, along a third path in a third direction, when the first and second retention members are disposed in their respective extended positions. The third direction is generally opposite to the first direction.

In a preferred embodiment of the present invention, the retainer is attached to a forward half of the outboard motor. The first and second extension surfaces are disposed in contact with the first and second retention members, respectively, when the first and second retention members are disposed in their respective extended positions to prevent the first and second extension portions from moving past the first and second retention members along the third path in the third direction.

In a particularly preferred embodiment of the present invention, the cowl latching system further comprises a locking mechanism attached to the cowl structure and a pin mechanism attached to the outboard motor. The locking mechanism is shaped to receive the pin mechanism and retain the pin mechanism therein. This particular embodiment of the present invention, which incorporates a locking mechanism and a pin mechanism, is particularly suited to implement the use of the integral latching mechanism describes above in conjunction with patent application Ser. No. 10/172,336 (M09576) which is shaped to retain a latch pin, or pin mechanism. The locking mechanism is attached to a rearward half of the outboard motor in a preferred embodiment. The first direction described above is generally downward from a position above the retainer when the outboard motor is in its normal operating position. The second direction is generally forward and away from the outboard motor when the outboard motor is in its normal operating position. The catch device is movable, along a fourth path in a fourth direction, toward the retainer to place the first and second extension portions at positions on opposite sides of the retainer while the first and second retention members are disposed in their respective extended positions, and remain in those positions as the catch member is movable along its fourth path in the fourth direction. The fourth direction is generally opposite to the second direction described above.

The first and second extension portions can be metallic and comprise planes which are generally parallel to each other. The catch device, along with its first and second extension portions and first and second extension surfaces, can be a one piece metallic structure. The first and second extension portions can be generally planar in shape.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
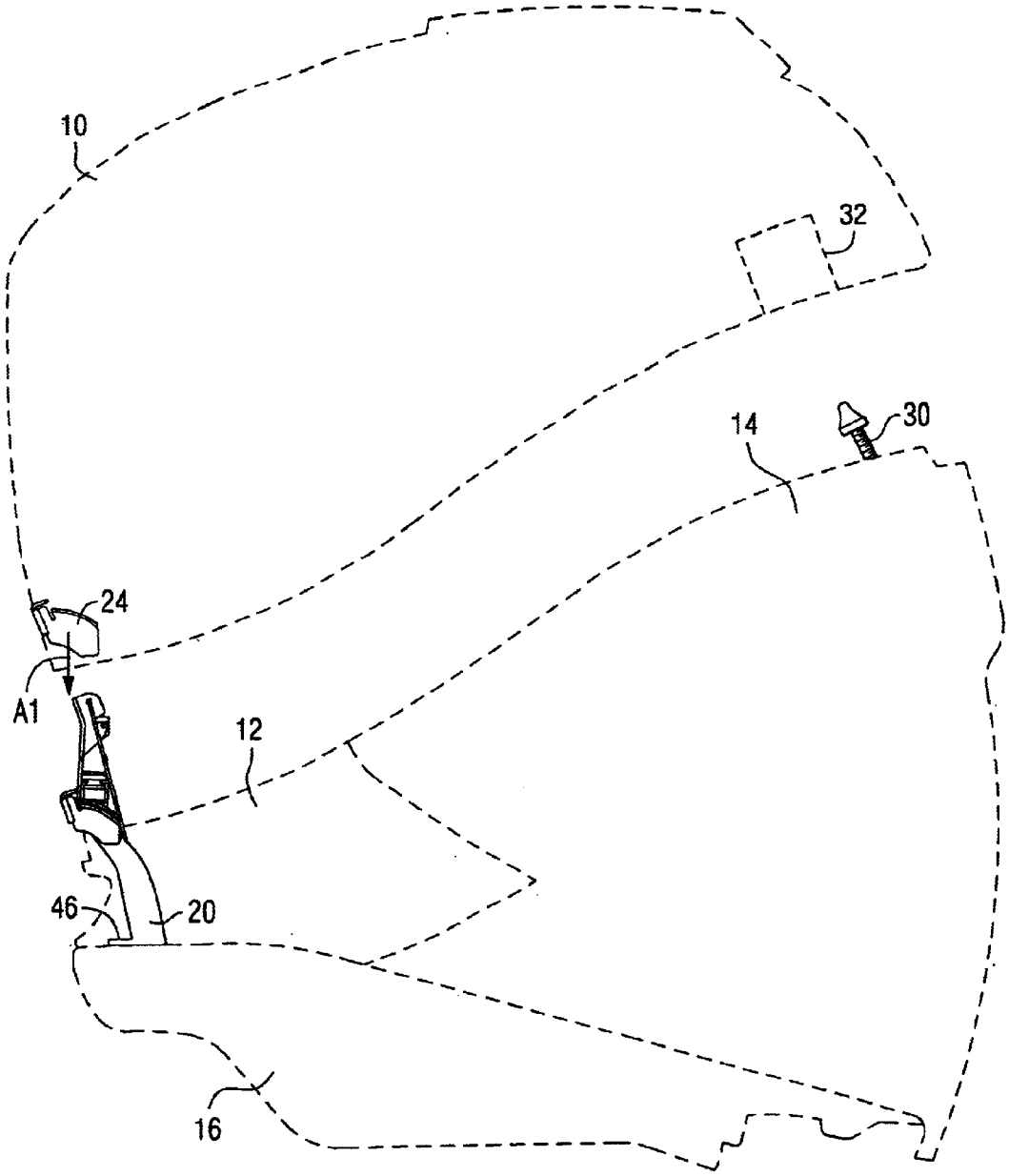
FIG. 1 shows the present invention associated with components of an outboard motor which are illustrated by dashed lines.

Throughout the description of the preferred embodiment of the present invention, like components will be identified by like reference numerals.

FIG. 1 shows an outboard motor with its upper cowl 10 spaced apart from the front cowl 12 and rear cowl 14 for purposes of illustrating the present invention. The cowl portions are represented by dashed lines in FIG. 1 to illustrate the relative positions of the portions of the present invention more clearly. The front portion of the outboard motor is located at the left side of FIG. 1 and the rear portion of the outboard motor is located on the right side of FIG. 1. The front cowl 12 and the rear cowl 14 are attachable to a support cradle 16.

The present invention comprises two primary portions, a retainer 20 and a catch device 24. The retainer 20 is attached to the outboard motor and, more particularly, to the support cradle 16. The catch device is attached to the cowl structure and, more particularly, to the upper cowl 10.

In FIG. 1, a pin mechanism 30 is shown attached to the outboard motor and, more particularly, to the rear cowl 14 of the outboard motor. A locking mechanism, represented by dashed line box 32, is shaped to receive the pin mechanism 30 and retain the pin mechanism therein. Although many different types of locking mechanisms can be used in conjunction with the present invention and located at the rearward portion of the outboard motor, the locking mechanism disclosed in U.S. patent application Ser. No. 10/172,336 (M09576), described above, is particularly useful in combination with the present invention. That patent application discloses an integral cowl latching mechanism, which can be located at the position represented by dashed box 32 in FIG. 1, that holds the upper cowl 10 rigidly in place relative to the front cowl 12 and the rear cowl 14. That type of latching mechanism can be located at the rearward portion of the outboard motor, as shown in FIG. 1 and used in combination with the present invention which is located at the forward portion of the outboard motor. However, it should be understood that other types of latching mechanisms can be used at the rearward portion of the outboard motor in place of the one described in U.S. patent application Ser. No. 10/172,336 (M09576). That particular mechanism is illustrated and described herein for the purpose of deciding the environment in which the present invention is particularly useful.

As will be described in greater detail below, a primary purpose of the present invention is to allow the upper cowl 10 to be installed in contact with the front cowl 12 and the rear cowl 14 through the use of a simplified installation procedure. The use of the present invention also beneficially provides several alternative methods of installing the upper cowl 10. As an example, moving the upper cowl 10 downward, along a first path in a first direction, represented by arrow Al allows the catch device 24 to engage the retainer 20. Once engaged, an upward movement in a direction opposite to arrow A1 is prevented by retention members attached to the retainer 20. After the catch device 24 is connected to the retainer 20, the cowl structure 10 can be further latched in position through the use of a latching mechanism, such as the locking mechanism 32 and the pin mechanism 30, which are located at the rearward portion of the outboard motor.

Figure 2:
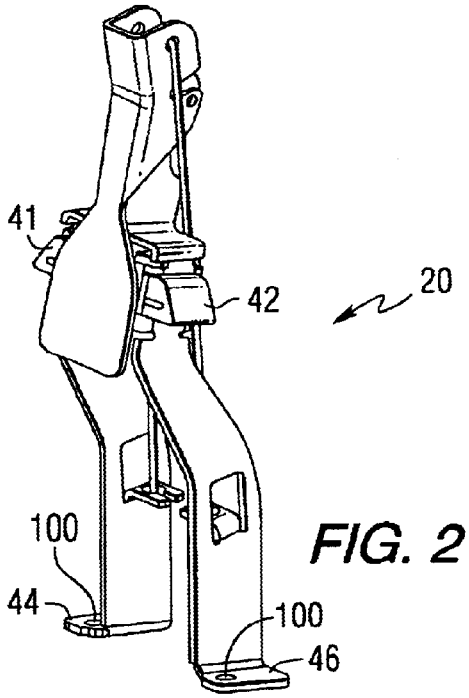
FIG. 2 is an isometric view of the retainer of the present invention.

FIG. 2 shows the retainer 20 of the present invention. A first retention member 41 is attached to the retainer 20 and is movable, relative to the retainer, between an extended position and a retracted position. The first retention member 41 is shown in the extended position in FIG. 1. When in the retracted position, the first retention member 41 would move toward the right in FIG. 2 and into the main structure of the retainer 20. A second retention member 42 is attached to the retainer 20 and is movable, relative to the retainer, between an extended position and a retracted position. Shown in the extended position in FIG. 2, the second retention member 42 can be moved into the body of the retainer 20 to assume its retracted position. The first and second retention members, 41 and 42, operate symmetrically and are urged into their respective extended positions, as shown in FIG. 2 when no external force is present to urge them into their respective retracted positions. In a preferred embodiment of the present invention, a spring mechanism is located between the first and second retention members, 41 and 42, to urge them away from each other and into their respective extended positions. The retainer 20 is provided with two feet, 44 and 46, which allows the retainer 20 to be rigidly attached to the outboard motor and, more particularly, to the support cradle 16 described above in conjunction with FIG. 1.

Figure 3:
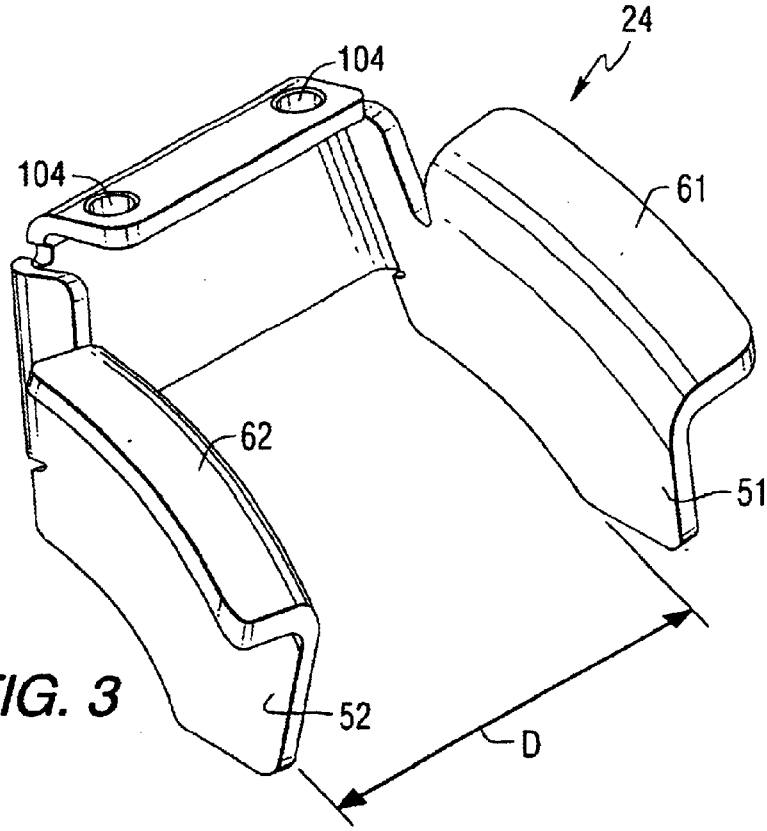
FIG. 3 is an isometric view of the catch device of the present invention.

FIG. 3 shows the catch device 24 of the present invention. It comprises a first extension portion 51 and a second extension portion 52. The first and second extension portions are disposed in a generally parallel association with each other as shown, but can exhibit a slight divergence from each in order to make it easier to move the catch member onto the retainer 20. The first extension portion 51 has a first extension surface 61 and a second extension portion 52 has a second extension surface 62. The first and second extension portion, 51 and 52, are spaced apart by a preselected distance D which is selected to allow a portion of the retainer 20 to pass between them. This preselected distance is also selected to urge the first and second retention members, 41 and 42, into their respective retracted positions as the catch device 24 is moved along the first path in a first direction A1, as described above in conjunction with FIG. 1, relative to the retainer 20. The interrelationship between the retainer 20 and the catch device 24 will be described in greater detail below.

The catch device 24 is removable from the retainer 20 while both the first and second retention members, 41 and 42, remain in their respective extended positions, as shown in FIG. 2, when the catch device 24 is moved along a second path in a second direction relative to the retainer. The first and second directions are nonparallel to each other and will be described in greater detail below. The first and second retention members, 41 and 42, are shaped to prevent the first and second extension portions, 51 and 52, from moving past them along a third path in a third direction when the first and second retention members, 41 and 42, are disposed in their respective extended positions as shown in FIG. 2. The third direction is generally opposite to the first direction Al described above in conjunction with FIG. 1.

Figure 4:
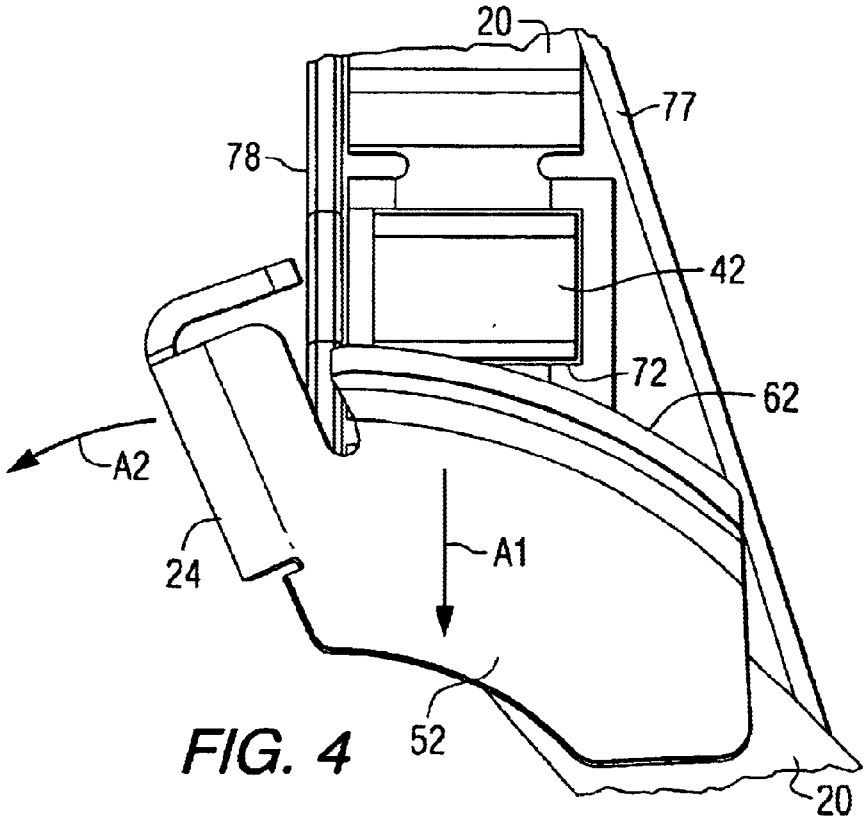
FIG. 4 shows a portion of the retainer associated with the catch device as the catch device is moved into its restrained position relative to the retainer.

FIG. 4 shows a side view of a section of the retainer 20 in combination with the catch device 24. The catch device 24 is in a position in FIG. 4 which shows the second retention member 42 in its retracted position (i.e. pushed in a direction into the body of the retainer 20) because of the action of the second extension portion 52 as the catch device 24 moves along the first path in the first direction A1. When the second extension surface 62 passes the lower surface 72 of the second retention member 42, the second retention member will be urged away from the first retention member and in a direction away from the surface of the illustration of FIG. 4.

For the purpose of clarity, the push-pull cable 77 and the lever 78 are shown attached for support to the retainer 20 in FIG. 4, but are not directly related to the operation of the retainer. These devices are associated with the side latches which release the rear cowl. These components are located at the retainer 20 for convenience and are not a necessary component of the present invention.

With continued reference to FIG. 4, the second path in a second direction A2 is also illustrated. Although not directly relevant when the catch device 24 is in the precise position shown in FIG. 4, it should be understood that after the catch device 24 is moved further in the first direction A1, the second retention member 42 will move into its extended position to provide a blocking force against the second extension surface 62 to prevent movement in a direction opposite to arrow A1. When that occurs, the catch device 24 remains able to be moved in the direction represented by arrow A2, as will be discussed in greater detail below. It should be understood that the retention members, 41 and 42, and the extension surfaces, 61 and 62, operate symmetrically and the operation of one side is the same as the other.

Figure 5:
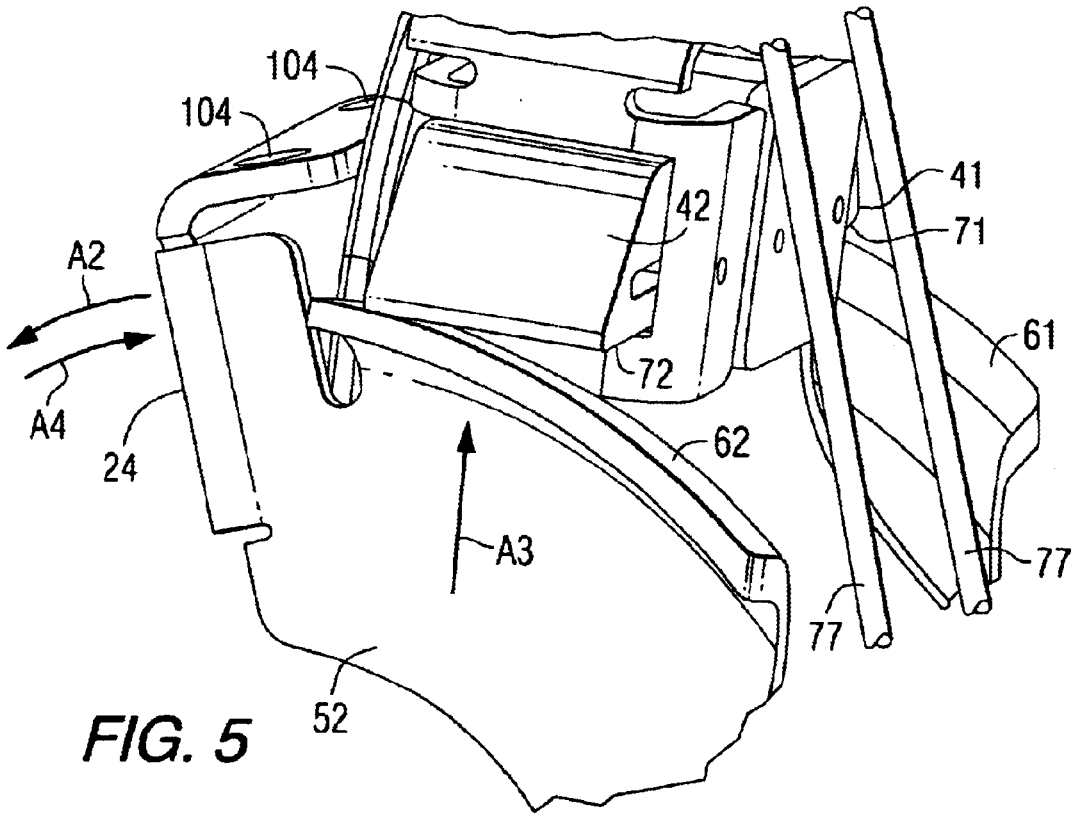
FIG. 5 shows the catch device and retainer with the catch device being retained in position by the retainer.

In FIG. 5 the catch device 24 is shown after it has moved further downward from the position shown in FIG. 4. After this occurs, the lower surface 72 of the second retention member 42 prevents the catch device 24 from moving along the third path in a third direction A3 because the second extension surface 62 moves into contact with the lower surface 72 of the second retention member 42 and this contact blocks further upward movement of the catch device 24. Similarly, the first extension surface 61 moves upwardly into contact with a lower surface of the first retention member 41. As a result, the first and second extension surfaces, 61 and 62, are blocked from further upward movement by the lower surfaces of the first and second retention members, 41 and 42, respectively.

With continued reference to FIG. 5, it can be seen that the first and second retention members, 41 and 42, do not prevent the catch device 24 from being moved along the second path in the second direction A2. As a result, the cowl structure 10 can be removed from the retainer 20 as long as the pin mechanism 30 is not locked in the locking mechanism 32. Once the rear portion of the cowl structure 10 is raised to separate the locking structure 32 from the pin structure 30, the catch device 24 allows the cowl to be moved in a forward direction, with the catch device 24 moving along the second path in the second direction A2.

As described above, in conjunction with FIG. 3, the first and second extension portions, 51 and 52, are spaced by distance D. This distance is selected so that, as the catch device 24 is moved in direction A1 , with a portion of the retainer 20 between them, they cooperate to force both the first and second retention members, 41 and 42, inward and toward each other into their respective retracted positions to allow the catch device 24 to proceed downwardly in direction A1. This downward movement of the catch device 24 continues until the first and second extension surfaces, 61 and 62, clear the lower surfaces of the first and second retention members, 41 and 42. At that point, an internal spring member causes the first and second retention members to move away from each other and into their respective extended positions, as shown in FIG. 5. When in the position illustrated in FIG. 5, the catch device 24 is prevented from moving in the third direction A3 which is generally upward. It is permitted to move in the second direction A2 to allow the operator of the marine vessel to remove the cowl structure 10 without having to cause the first and second retention members, 41 and 42, to be moved into their retracted positions.

When the first and second retention members, 41 and 42, are in their extended positions as shown in FIG. 5, it is possible for the catch device 24 to be moved along a fourth path in a fourth direction A4 to allow the operator to install the cowl structure 10 without having to move the first and second retention members, 41 and 42, into their retracted positions. By moving the cowl 10 in a direction that causes the catch device 24 to move along the fourth path in the fourth direction A4, the first and second extension surfaces, 61 and 62, can slide relative to the lower surfaces of the first and second retention members, 41 and 42. As a result, the operator can install the cowl structure 10 with relative ease. After the catch device 24 is moved into the position shown in FIG. 5, the rearward portion of the cowl structure 10 can be moved downwardly to cause the locking mechanism 32 to capture the pin mechanism 30 and retain the rear portion of the cowl structure 10 in position relative to the rear cowl 14.

Figure 6:
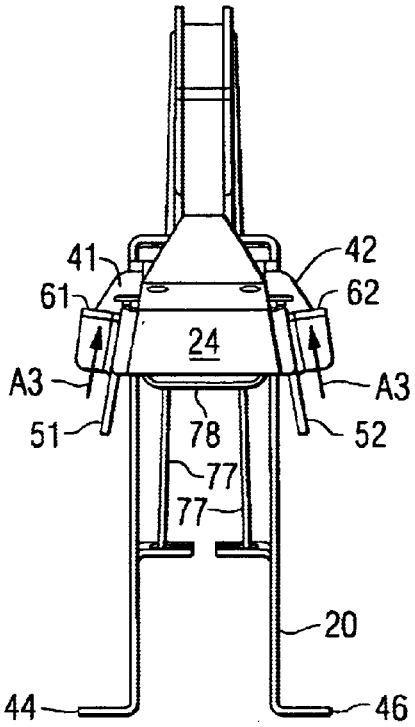
FIGS. 6–8 show various views of both the retainer and catch device of the present invention.
Figure 7:
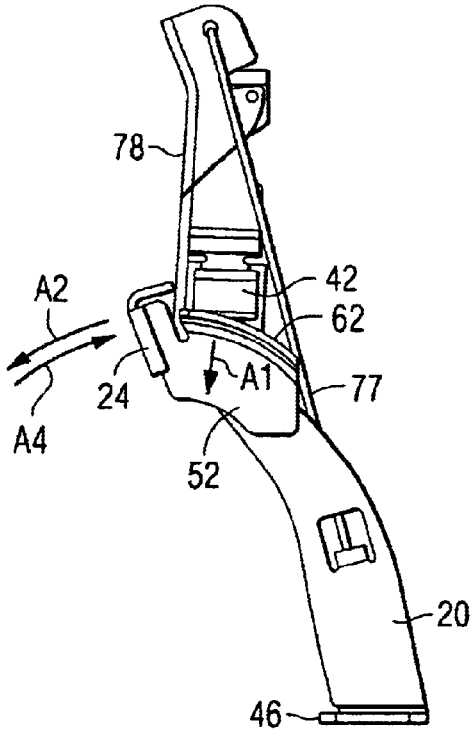
Figure 8:
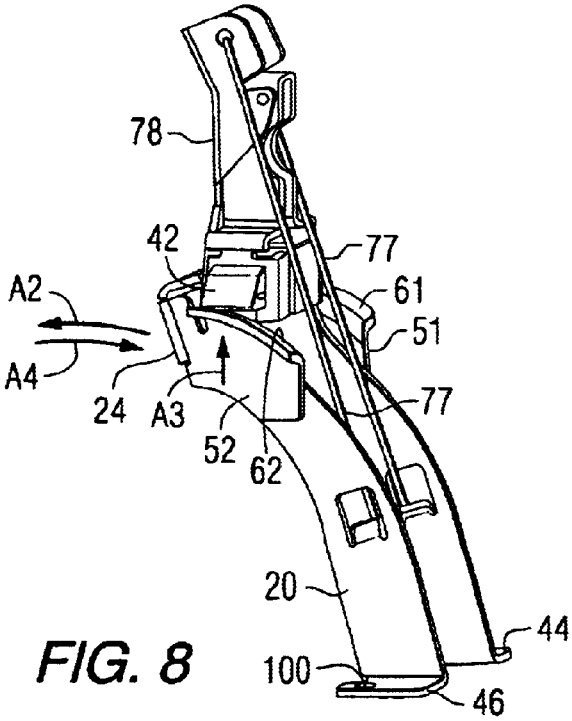

FIGS. 6–8 show the present invention in several alternative views. FIG. 7 shows the catch device 24 in a position as it moves downwardly in a direction A1 to force the first and second retention members, 41 and 42, into their retracted positions to allow the first and second extension portions, 51 and 52, to pass.

FIGS. 6 and 8 show the catch device 24 in a position below the first and second retention members, 41 and 42, with the first and second extension surfaces, 61 and 62, blocked from further upward movement in direction A3 by the lower surfaces of the first and second retention members, 41 and 42. In FIG. 7, direction A1 illustrated. In FIGS. 7 and 8, direction A2 is illustrated. In FIGS. 6 and 8, direction A3 is illustrated and in FIGS. 7 and 8 direction A4 is illustrated.

With continued reference to FIGS. 6–8, it should also be understood that the catch device 24 can be moved along a path that is generally parallel to direction A4, but with the catch device 24 being located slightly higher than that shown in FIG. 7. In other words, the catch device 24 can be moved in a direction from left to right in FIG. 7 with the first and second extension portions, 51 and 52, moving into contact with the upper surfaces of the first and second retention members, 41 and 42, so that the first and second retention members are moved into their retracted positions, respectively, by the movement toward the right and downwardly in FIG. 7 during the installation of the cowl structure 10.

Figure 9:
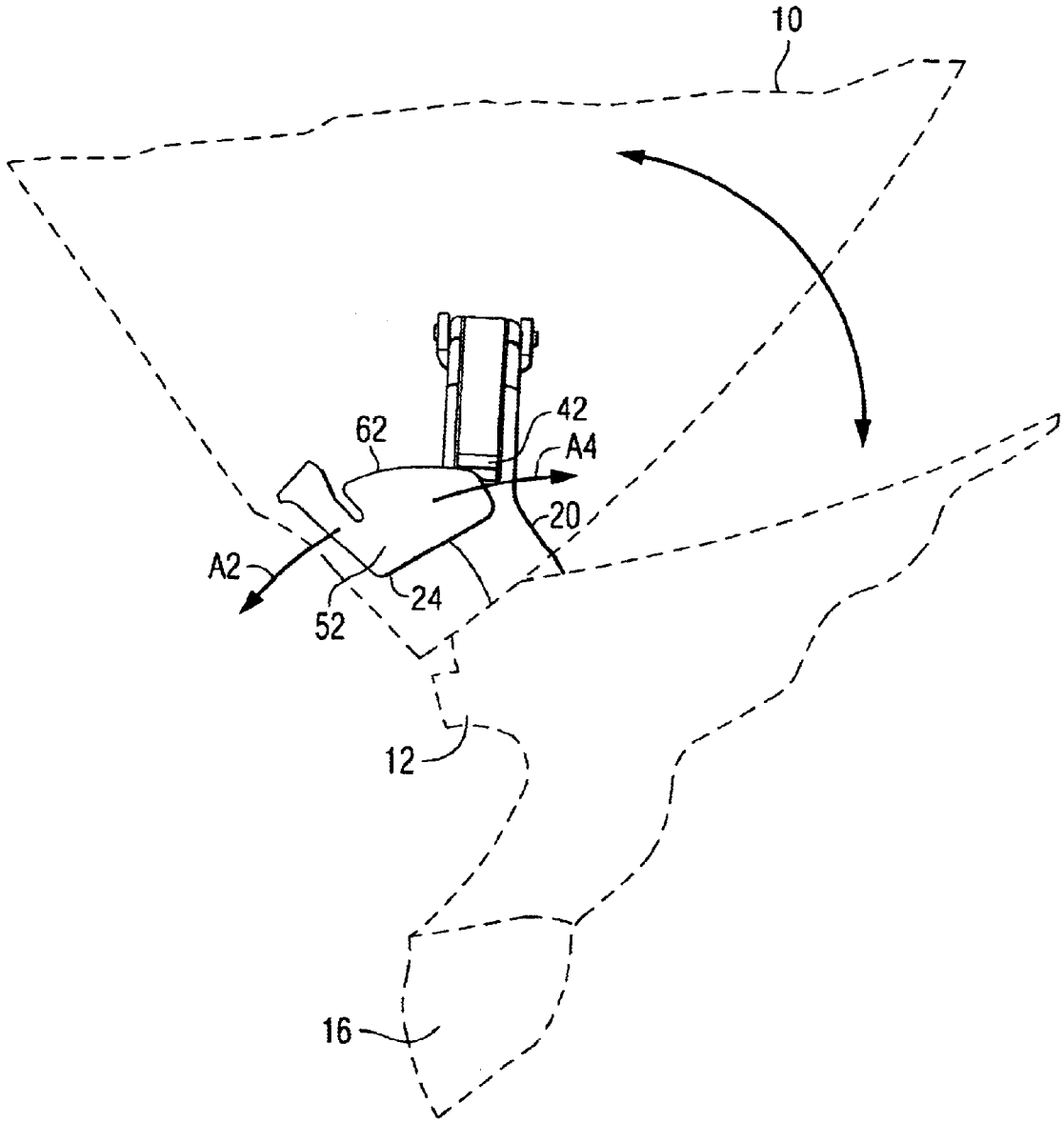
FIG. 9 is a partial view of the present invention during the installation and/or removal of a cowl structure from an outboard motor.

FIG. 9 is intended to more clearly illustrate the capability of the catch device 24 to move in both the second and fourth directions, A2 and A4. Even with the first and second retention members, 41 and 42, in their extended positions, the catch device 24 can be removed from the retainer 20 by tilting the cowl structure 10 to lift the locking mechanism 32 upwardly and away from the pin mechanism 30. When this is done, as shown in FIG. 9, the catch device 24 can be moved in the second direction A2 to remove it from contact with the retainer 20 and thereby remove the cowl structure 10 from the outboard motor.

When installing the cowl structure 10, the catch device 24 can be moved to place the first and second extension surfaces, 61 and 62, under the lower surfaces of the first and second retention members, 41 and 42, to allow the cowl structure to be moved so that the catch device 24 moves in the fourth direction A4. It should also be clearly understood that the first and second extension portions, 51 and 52, can be placed slightly above and forward (to the left in FIG. 9) from the first and second retention members, 41 and 42, to allow the first and second extension portions, 51 and 52, to move downwardly onto the upper surfaces of the first and second retention members, 41 and 42, to simultaneously urge those retention members into their retracted positions as the catch device 24 moves downwardly and toward the right in FIG. 9. This movement (downward and to the right in FIG. 9) is continued as the cowl structure 10 is rotated in a clockwise direction until the first and second extension surfaces, 61 and 62, move downwardly past the lower surfaces of the first and second retention members, 41 and 42, to capture the catch device 24 in relation to the retainer 20. The clockwise rotation of the cowl structure 10 is continued until the pin mechanism 30 is captured in the locking mechanism 32.

With reference to FIGS. 1–9, holes 100 are provided in the feet of the retainer 20 to allow the retainer 20 to be rigidly attached to the outboard motor and, more particularly, to the support cradle 16 of the outboard motor. Holes 104 are provided in the catch device 24 to allow it to be rigidly attached to the cowl structure 10. The catch device 24 moves in coordination with the cowl structure when the operator of a marine vessel maneuvers the cowl structure 10 into position relative to the outboard motor.

With continued reference to FIGS. 1–9, the cowl latching system of the present invention provides a cowl structure 10 which is removably attachable to the outboard motor. A retainer 20 is attached to the outboard motor and, more particularly, to the support cradle 16 of the outboard motor. A first retention member 41 is attached to the retainer 20 and is movable relative to the retainer between an extended position and a retracted position. A second retention member 42 is also attached to the retainer 20 and similarly movable relative to the retainer between an extended position and a retracted position. The first and second retention members, 41 and 42, are urged into their respective extended positions when no external force is present to urge them into their respective retracted positions. This is accomplished by an internal resilient component, such as a spring, disposed between the first and second retention members. A catch device 24 is attached to the cowl structure 10. The catch device comprises first and second extension portions, 51 and 52, which can be disposed in a generally parallel association with each other or with a slight divergence from each other. The first extension portion 51 has a first extension surface 61 and the second extension portion 52 has a second extension surface 62. The first and second extension portions are spaced apart by a preselected distance D which is selected to allow a portion of the retainer to pass between them and to urge the first and second retention members, 41 and 42, into their respective retracted positions when the catch device 24 is moved along a first path in a first direction A1 relative to the retainer. The catch device 24 is removable from the retainer 20 while the first and second retention members, 41 and 42, remain in their extended positions when the catch device 24 is moved along a second path in a second direction A2 relative to the retainer 20. The first and second directions, A1 and A2, are generally nonparallel to each other. The first and second retention members, 41 and 42, are shaped to prevent the first and second extension portions, 51 and 52, from moving past them along a third path in a third direction A3 when the first and second retention members, 41 and 42, are disposed in their extended positions. The third direction A3 is generally opposite to the first direction A1. The retainer 20 is attached to a forward portion of the outboard motor. The first and second extension surfaces, 61 and 62, are disposed in contact with lower surfaces of the first and second retention members, 41 and 42, when the first and second retention members are disposed in their respective extended positions to prevent the first and second extension portions, 51 and 52, from moving past them along the third path in the third direction A3.

One embodiment of the present invention further comprises a locking mechanism 32 attached to the cowl structure 10 and a pin mechanism 30 attached to the outboard motor 30. The pin mechanism 30 can be attached to a rear cowl 14. The locking mechanism 32 is shaped to receive the pin mechanism and retain the pin mechanism therein. The locking mechanism 32 is attached to a rearward portion of the outboard motor. The first direction A1 is generally downward from a position above the retainer 20 when the outboard motor is in its normal operating position, as shown in FIG. 1. The second direction A2 is generally forward and away from the outboard motor when the outboard motor is in its normal operating position. The catch device 24 is movable along a fourth path in a fourth direction A4 toward the retainer 20 to place the first and second extension portions, 51 and 52, at positions on opposite sides of the retainer 20 while the first and second retention members, 41 and 42 are disposed in their respective extended positions. The fourth direction A4 is generally opposite to the second direction A2. The first and second extension portions, 51 and 52, can comprise planes which are generally parallel to each other. The catch device 24 and its first and second extension portions, 51 and 52, can be made of a single metallic component.

Although the present invention has been described in particular detail and illustrated to specifically show a preferred embodiment, it should be understood that alternative embodiments are also within its scope.

We claim:

1. A cowl latching system for an outboard motor, comprising:

a cowl structure which is removably attachable to said outboard motor;

a retainer attached to said outboard motor;

a first retention member attached to said retainer, said first retention member being movable, relative to said retainer, between an extended position and a retracted position;

a second retention member attached to said retainer, said second retention member being movable, relative to said retainer, between an extended position and a retracted position, said first and second retention members being urged into their respective extended positions when no external force is present to urge said first and second retention members into their respective retracted positions; and a catch device attached to said cowl structure, said catch device comprising a first extension portion and a second extension portion, said first extension portion having a first extension surface, said second extension portion having a second extension surface, said first and second extension portions being spaced apart by a preselected distance which is selected to allow a portion of said retainer to pass between them and to urge said first and second retention members into their respective retracted positions when said catch device is moved along a first path in a first direction relative to said retainer, said catch device being removable from said retainer while said first and second retention members remain in their respective extended positions when said catch device is moved along a second path in a second direction relative to said retainer, said first and second directions being nonparallel to each other, said first and second retention members being shaped to prevent said first and second extension portions from moving past them, along a third path in a third direction, when said first and second retention members are disposed in their respective extended positions, said third direction being generally opposite to said first direction.

2. The cowl latching system of claim 1, wherein:

said retainer is attached to a forward half of said outboard motor.

3. The cowl latching system of claim 1, wherein:

said first and second extension surfaces are disposed in contact with said first and second retention members, respectively, when said first and second retention members are disposed in their respective extended positions to prevent said first and second extension portions from moving past said first and second retention members along said third path in said third direction.

4. The cowl latching system of claim 1, further comprising:

a locking mechanism attached to said cowl structure; and a pin mechanism attached to said outboard motor, said locking mechanism being shaped to receive said pin mechanism and retain said pin mechanism therein.

5. The cowl latching system of claim 4, wherein:

said locking mechanism being attached to a rearward half of said outboard motor.

6. The cowl latching system of claim 1, wherein:

said first direction is generally downward from a position above said retainer when said outboard motor is in its normal operating position.

7. The cowl latching system of claim 1, wherein:

said second direction is generally forward and away from said outboard motor when said outboard motor is in its normal operating position.

8. The cowl latching system of claim 1, wherein:

said catch device is movable, along a fourth path in a fourth direction, toward said retainer to place said first and second extension portions at positions on opposite sides of said retainer while said first and second retention members are disposed in their respective extended positions, said fourth direction is generally opposite to said second direction.

9. The cowl latching system of claim 1, wherein:

said first and second extension portions comprise planes which are generally parallel to each other.

10. The cowl latching system of claim 1, wherein:

said first and second extension portions are each generally planar in shape.

11. A cowl latching system for an outboard motor, comprising:

a cowl structure which is removably attachable to said outboard motor;

a retainer attached to a forward portion of said outboard motor;

a first retention member attached to said retainer, said first retention member being movable, relative to said retainer, between an extended position and a retracted position;

a second retention member attached to said retainer, said second retention member being movable, relative to said retainer, between an extended position and a retracted position, said first and second retention members being urged into their respective extended positions when no external force is present to urge said first and second retention members into their respective retracted positions; and a catch device attached to said cowl structure, said catch device comprising a first extension portion and a second extension portion, said first and second extension portions being disposed in a generally parallel association with each other, said first extension portion having a first extension surface, said second extension portion having a second extension surface, said first and second extension portions being spaced apart by a preselected distance which is selected to allow a portion of said retainer to pass between them and to urge said first and second retention members into their respective retracted positions when said catch device is moved along a first path in a first direction relative to said retainer, said catch device being removable from said retainer while said first and second retention members remain in their respective extended positions when said catch device is moved along a second path in a second direction relative to said retainer, said first and second directions being nonparallel to each other, said first and second retention members being shaped to prevent said first and second extension portions from moving past them, along a third path in a third direction, when said first and second retention members are disposed in their respective extended positions, said third direction being generally opposite to said first direction, said first and second extension surfaces being disposed in contact with said first and second retention members, respectively, when said first and second retention members are disposed in their respective extended positions to prevent said first and second extension portions from moving past said first and second retention members along said third path in said third direction.

12. The cowl latching system of claim 11, further comprising:

a locking mechanism attached to said cowl structure; and a pin mechanism attached to said outboard motor, said locking mechanism being shaped to receive said pin mechanism and retain said pin mechanism therein.

13. The cowl latching system of claim 12, wherein:

said locking mechanism being attached to a rearward half of said outboard motor.

14. The cowl latching system of claim 13, wherein:

said first direction is generally downward from a position above said retainer when said outboard motor is in its normal operating position.

15. The cowl latching system of claim 14, wherein:

said second direction is generally forward and away from said outboard motor when said outboard motor is in its normal operating position.

16. The cowl latching system of claim 15, wherein:

said catch device is movable, along a fourth path in a fourth direction, toward said retainer to place said first and second extension portions at positions on opposite sides of said retainer while said first and second retention members are disposed in their respective extended positions, said fourth direction is generally opposite to said second direction.

17. The cowl latching system of claim 16, wherein:

said first and second extension portions are generally parallel to each other.

18. The cowl latching system of claim 17, wherein:

said first and, second extension portions are each generally planar in shape.

19. A cowl latching system for an outboard motor, comprising:

a cowl structure which is removably attachable to said outboard motor;

a retainer attached to a forward portion of said outboard motor;

a first retention member attached to said retainer, said first retention member being movable, relative to said retainer, between an extended position and a retracted position;

a second retention member attached to said retainer, said second retention member being movable, relative to said retainer, between an extended position and a retracted position, said first and second retention members being urged into their respective extended positions when no external force is present to urge said first and second retention members into their respective retracted positions; and a catch device attached to said cowl structure, said catch device comprising a first extension portion and a second extension portion, said first and second extension portions being disposed in a generally parallel association with each other, said first and second extension portions being each generally planar in shape, said first extension portion having a first extension surface, said second extension portion having a second extension surface, said first and second extension portions being spaced apart by a preselected distance which is selected to allow a portion of said retainer to pass between them and to urge said first and second retention members into their respective retracted positions when said catch device is moved along a first path in a first direction relative to said retainer, said catch device being removable from said retainer while said first and second retention members remain in their respective extended positions when said catch device is moved along a second path in a second direction relative to said retainer, said first and second directions being nonparallel to each other, said first and second retention members being shaped to prevent said first and second extension portions from moving past them, along a third path in a third direction, when said first and second retention members are disposed in their respective extended positions, said third direction being generally opposite to said first direction, said first and second extension surfaces being disposed in contact with said first and second retention members, respectively, when said first and second retention members are disposed in their respective extended positions to prevent said first and second extension portions from moving past said first and second retention members along said third path in said third direction.

20. The cowl latching system of claim 19, further comprising:

a locking mechanism attached to said cowl structure; and a pin mechanism attached to said outboard motor, said locking mechanism being shaped to receive said pin mechanism and retain said pin mechanism therein.

21. The cowl latching system of claim 20, wherein:

said first direction is generally downward from a position above said retainer when said outboard motor is in its normal operating position.

22. The cowl latching system of claim 21, wherein:

said second direction is generally forward and away from said outboard motor when said outboard motor is in its normal operating position.

* * * * *